US005312062A

United States Patent [19]

Lieb

[11] Patent Number: 5,312,062

[45] Date of Patent: May 17, 1994

[54] DEVICE FOR MONITORING THE THREAD RUN ON A BOBBIN CREEL

[75] Inventor: Heiner Lieb, Kreuzlingen, Switzerland

[73] Assignee: Benninger AG, Uzwil, Switzerland

[21] Appl. No.: 865,292

[22] Filed: Apr. 8, 1992

[30] Foreign Application Priority Data

Apr. 24, 1991 [CH] Switzerland ..... 1221/91-2

[51] Int. Cl.[5] ..... B65H 49/00; B65H 59/22

[52] U.S. Cl. ..... 242/131.1; 242/150 R

[58] Field of Search ..... 242/131, 131.1, 149, 242/150 R

[56] References Cited

U.S. PATENT DOCUMENTS

| | | | |
|---|---|---|---|
| 3,873,043 | 3/1975 | Wildi et al. | 242/131.1 |
| 4,272,038 | 6/1981 | Wildi | 242/150 R |
| 4,548,369 | 10/1985 | Bossart | 242/150 R |
| 4,598,184 | 7/1986 | Price et al. | 242/131.1 X |
| 4,646,989 | 3/1987 | Van Wilson | 242/131.1 |
| 4,664,335 | 5/1987 | Kohlen | 242/131.1 |
| 5,040,742 | 8/1991 | Buttermann | 242/131.1 |

FOREIGN PATENT DOCUMENTS 0311781 4/1989 European Pat. Off. .

*Primary Examiner*—Stanley N. Gilreath
*Attorney, Agent, or Firm*—Shoemaker and Mattare Ltd.

[57] ABSTRACT

A thread clamping device for a textile machine includes a clamping pad which is pressed against a clamping rib by a compression spring. The spring force can be adjusted, independent of other like devices associated with the machine, by an adjusting mechanism including a slider with an inclined surface supporting one end of the spring, wherein movement of the slider alters the precompression of the spring. The clamp is normally held open by a cam which overrides the spring, but when thread tension falls below an adjustable threshold, a tension monitor automatically activates the clamp.

5 Claims, 3 Drawing Sheets

DEVICE FOR MONITORING THE THREAD RUN ON A BOBBIN CREEL

The invention concerns a device for monitoring the thread run on a bobbin creel, in particular on a warping creel. These types of devices serve the purpose of applying, on the one hand, a definite thread tension to threads withdrawn from the bobbin creel, and however, on the other hand, of detecting a reduction in thread tension, for example in the case of thread breakage, and of clamping the thread firmly when the machine is stopped as a result of this condition in order to avoid running on. Comparable devices are employed particularly in the case of V-shaped warping creels with which the deflection of the threads towards the winding device occurs directly at a detecting or monitoring needle.

Related, comparable devices are, for example, described in U.S. Pat. No. 4,598,184 or in EP-A-311 781. Here, until now the clamping devices have been acted upon with a constantly uniform pressing force, each different type of thread being clamped firmly with the same clamping force. With EP-A-311 781, the spring device is indeed provided with an additional control spring which permits relief of the clamping pads. Of course, this type of relief is only possible within an entire vertical row of clamping devices, since the relief ensues via the vertical control rods for opening and closing the clamping pads. Individual adjustment of the spring force at each individual clamping device is, however, not possible. In many cases it is desirable, however, that the clamping force can be adjusted to the thread quality, independently from the location of the respective bobbin position on the bobbin creel. Until now it has been customary to incorporate springs of differing strengths into the clamping devices, for which purpose, however, a time consuming disassembly has been necessary.

It is therefore a purpose of the invention to create a device of the type mentioned in the introduction, where the clamping force of the clamping device can be individually adjusted to each individual bobbin position in a simple way. This purpose is fulfilled, according to the invention, with a device as described below The adjustment devices allocated to each clamping device permit adjustment of the spring force of the spring device to the individual circumstances in the simplest way.

The spring device is, with particular advantage, formed as a compression spring which is mounted on a pressure peg connected to the clamping pad, the pressure peg being coordinated at its end with a guide member and thereby being able to be pressed against the force of the spring into the open position, and the counter bearing of the compression spring on the pressure peg being formed to be adjustable. Activation of the clamping plate via a pressure peg has indeed already been made known in the patent publication mentioned in the introduction. The displaceable counter bearing permits tensioning or release of the compression spring in the simplest way, however. The counter bearing can be displaced with particular advantage by means of a linearly displaceable slider which possesses a guide element.

In practice, the adjustment device could comprise solely this slider which, for example, can be manually adjusted. However a particularly advantageous activation of the slider can be achieved by providing a pivotable adjustment lever which engages in a prismatic joint at its free end. The adjustment lever can be turned with a screw driver, for example. In order to avoid unintentional changes to the position of the adjustment lever, this can be fixed by means of a cover plate which also simultaneously covers the clamping device and the adjustment device and thus, serves as a protection from dust and fibers. The cover plate can have an opening with a marked scale from which the adjusted position of the lever can be read. Securing of the once selected position by means of the cover plate has the advantage that this adjustment is not lost through negligence. For resetting of the position, the cover plate must be loosened, which is only permitted by authorized personnel. Particular flexibility of the device will result if the monitoring needle of the thread monitor is pretensioned with a tension spring, the mounting position of which, on the frame side, is able to be adjusted in order to change the tensioning force. In this way, the thread tension, respectively the reaction time of the monitoring needle can also be adjusted within definite limits to the thread being withdrawn. The tension spring can for this purpose likewise be attached to an adjustment lever which is mounted to pivot.

Clamping devices and thread monitors must not of necessity be arranged adjacent to one another within the bobbin creel. It is, however, advantageous if the clamping device and the thread monitor form a unit with a common base plate and if the adjustment lever for the clamping device and the adjustment lever for the thread monitor are able to be held fast with a common cover plate. Thus, the adjustment for the spring force which takes effect on the monitoring needle can also be secured in the same way, reading off of the adjustment being possible from outside via a corresponding opening in the cover plate and a scale marked thereon.

An embodiment of the invention is portrayed in the drawings wherein.

Figure 1:
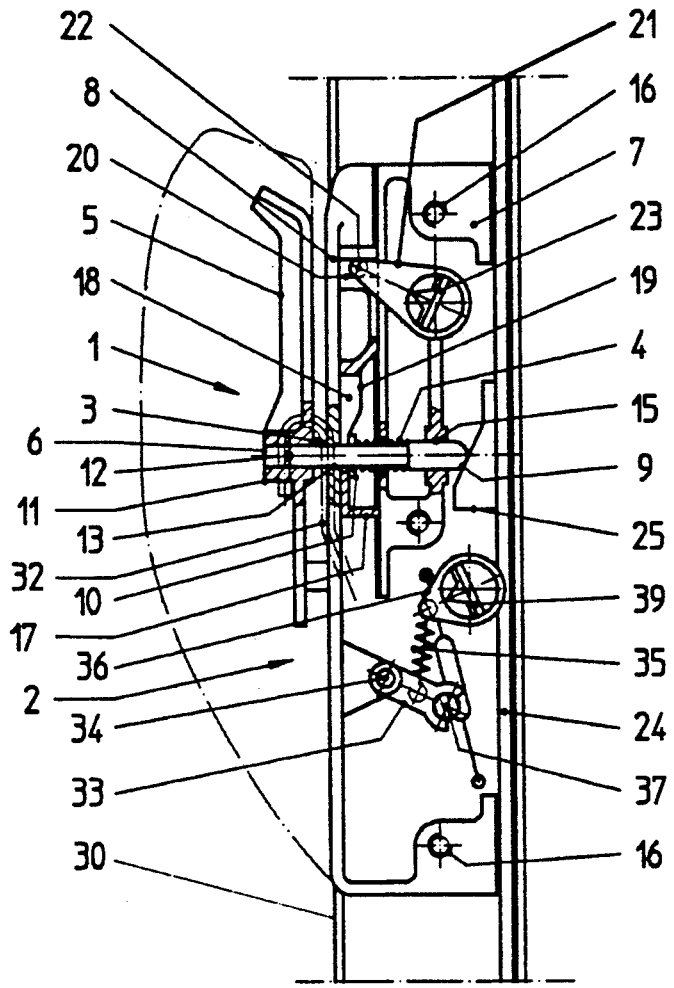
FIG. 1 is a partial sectional side view of a device embodying the invention with the cover plate removed.
Figure 2:
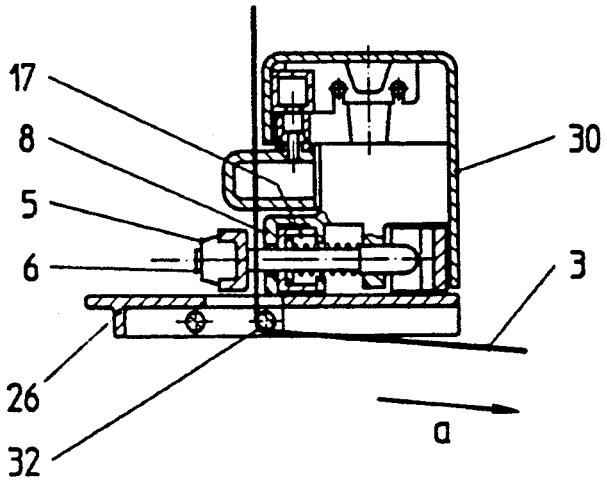
FIG. 2 is a plan view of the device according to FIG. 1.

As can be observed, especially in FIGS. 1 and 2, the device comprises a unit within which the clamping device 1 and the thread monitor 2 are arranged on a common base plate 7. This base plate is attached to the vertical U-channel 30 which is arranged in front of each vertical row of bobbin positions on the creel. The thread 3 coming from the thread bobbin, which is here not shown, runs between a moveable clamping pad 5 and a rigid clamping rib 8 and is deflected around the monitoring needle 32, from which position it runs towards the winding device in the direction of the arrow a.

The clamping pad 5 possesses a hub 11 in which a pressure peg 6 is fixed with the aid of a securing pin 12. This pressure peg has a rounded head 9 of extended diameter on its free end which acts together with a guide member 25 on a vertical control rod 24. The pressure peg 6 is on the one hand guided in a bore 13 within the clamping rib 8 and on the other hand guided in a bore 15 in the base plate 7 in such a way that the clamping pad 5 may move away from while remaining parallel to the clamping rib 8. The clamping pad 5 is thus pressed against the clamping rib 8 with the aid of a compression spring 4. This compression spring supports itself on the extended head 9 and rests on a U-washer 10 which serves as a counter bearing.

In the position portrayed, the guide member 25 is in the operating position so that the clamping pad 5 is pressed away from the clamping rib against the force of the press spring 4.

A slider 17 is arranged behind the clamping rib 8 in a shaft type inset in the base plate which can be displaced linearly and approximately at right angles to the pressure peg 6. The slider has a slot 18 which permits enclosure of the pressing peg 6 in each relative position. While the slider is formed evenly on one side of the clamping rib 8, the opposing side has a guide member 19 on which the U-washer 10 can slide. The slider is provided with a horizontal groove 20 in its upper region. The slider is actuated by means of the adjustment lever 21. This is mounted on the base plate 7 to be able to rotate and possesses a slot 23 into which a screw driver can be employed. A cam 22 on the free end of the lever, together with the groove 20 in the slider 17, forms a prismatic joint, with the aid of which the rotational movement is transformed into a thrust movement.

The thread monitor 2 incorporates the monitor needle 32 which has already been briefly mentioned, which is however only suggested in FIG. 1. This monitoring needle has a hooked end and is mounted on a linkage 34 so that it can pivot. The monitoring needle is formed as an double lever, a tension spring 35 being attached on the lever arm 33 which gives a definite torque to the monitoring needle. The opposite end of the tension spring 35 is attached to an adjustment lever 36, mounted to be able to rotate, which is likewise provided with a slot 39 in order to rotate it. Apart from that, the end of the lever arm 33 coordinates with a switch device 37 which, at a certain lever position, triggers a switching sequence for stopping of the machine and activation of the clamping device 1.

Figure 3:
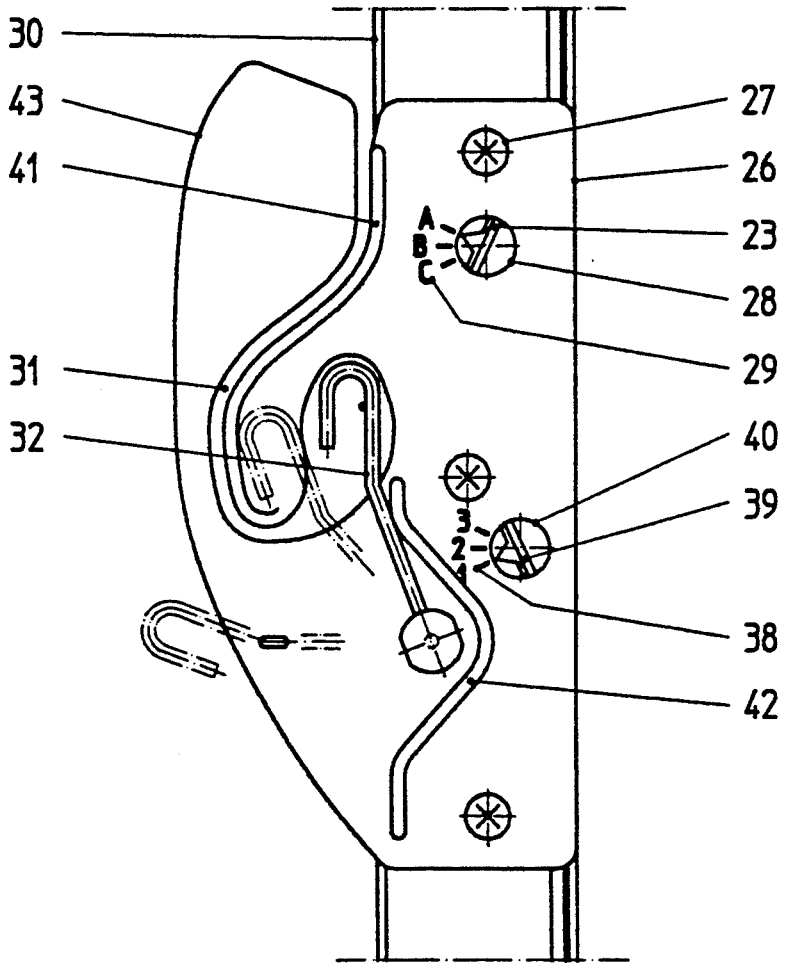
FIG. 3 is a side elevation of device according to FIG. 1 with the cover plate fastened by screws and the monitor needle in use.

The base plate 7 is provided with threaded bores 16 at three different points. These bores serve to fasten a cover plate 26 which can be observed in FIG. 3. This cover plate can be screwed down towards the base plate 7 with the aid of the screws 27. Both the adjustment levers 21 and 36 are arranged in the plane of the base plate in such a way that they can no longer pivot out of position when the cover plate is screwed down. However, openings 28 and 40 are arranged in the cover plate through which the positioning of the adjustment levers can be observed. In each case, markings 29 and 38 on the cover plate permit, additionally, reading off of the position of the repective selected adjustment.

The cover plate 26 is provided at its side with a blade 43 which protrudes beyond the U-profile. A hooked shaped slit 31, through which the thread can be introduced, is arranged in this blade. An upper rib 41 runs alongside this slit which at the same time serves as a stop for the monitoring needle in its lowered position when the thread has suffered breakage. This position is suggested by the dotted line in FIG. 3. A lower rib 42 on the cover plate serves as a rear limit to the monitoring needle 32 at normal thread tension in the operating position. The monitoring needle can be disengaged from the linkage 34 by means of a bayonette coupling which is not shown here in any greater detail. In order to change the position by the adjustment levers 21 and 36 it is sufficient if the screws 27 are loosened until the adjustment levers can be rotated at the slots 23 and 39 to the desired position through the openings 28 and 40.

Figure 4:
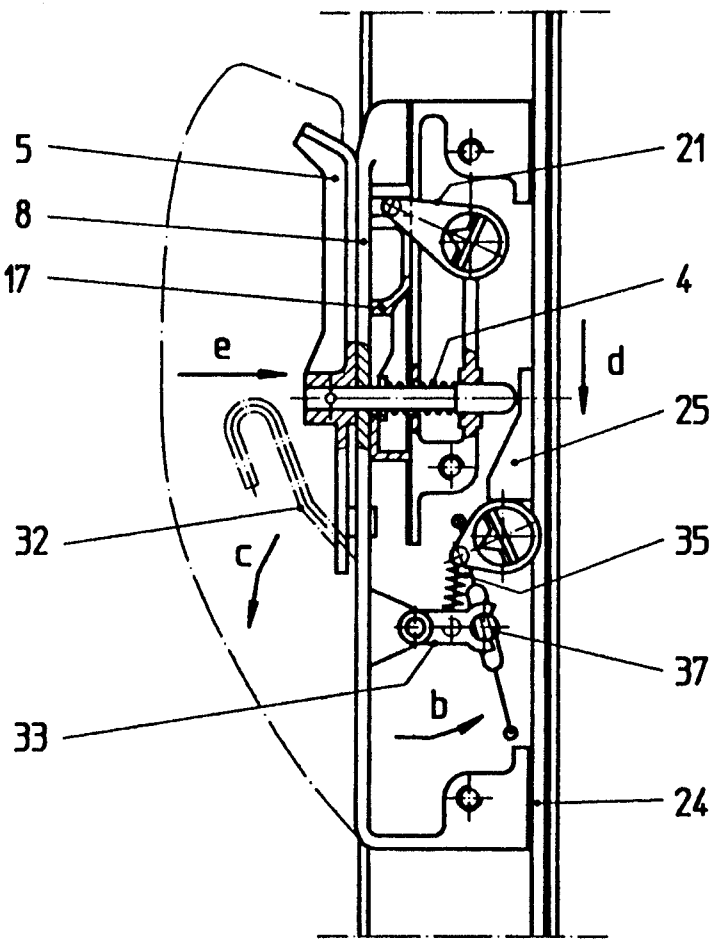

FIG. 4 shows once again the device according to FIG. 1 with the same basic adjustment, however with closed clamping pads. This position is achieved on stopping of the machine which, for example, is triggered through thread breakage. If the thread tension reduces suddenly, the tension spring 35 pulls the lever arm 33 upwards in the direction of the arrow b, the monitoring needle 32 being pivoted in the direction of the arrow c. The switching device 37, actuated at the same time, switches off the winding machine and simultaneously activates the control rod 24 which is displaced in the direction of the arrow d with the aid of a drive device which is not depicted in any more detail. With that, the guide element 25 releases the pressure peg 6 which, under the tension of the compression spring 4, is moved in the direction of the arrow e. The clamping pad 5 is pressed against the clamping rib 8, running on of the thread being avoided and the thread being held under tension.

Figure 5:
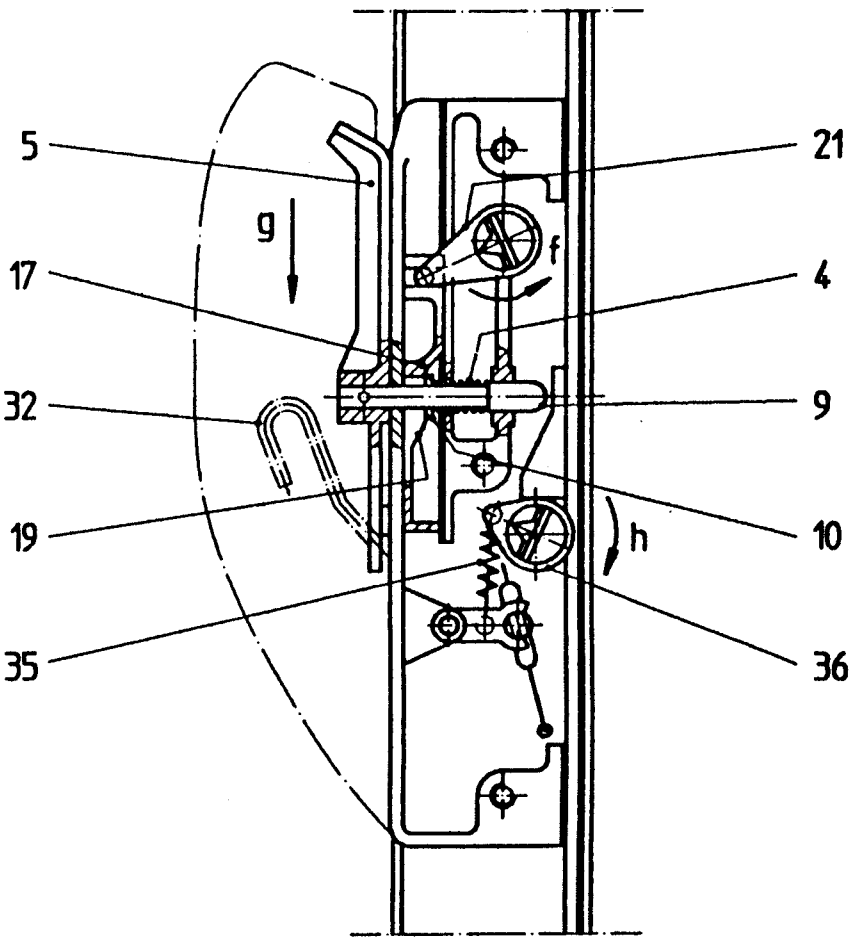
FIG. 4 depicts the device according to FIG. 1 with closed clamping pads and FIG. 5 shows the device according to FIG. 1 with closed clamping pads, but with an altered spring adjustment for the clamping device and for the thread monitor.

To increase the pressure on the clamping pad 5 so that the monitoring needle 32 tensions the threads more strongly, the alternations according to FIG. 5 will be undertaken. The adjustment lever 21 is rotated in the direction of the arrow f, pushing the slider 17 downwards in the direction of the arrow g. Consequently, the U-washer 10 is pressed by the guide element 19 towards the head 9, the compression spring 4 coming under greater tension as a result.

In the same way, through rotation of the adjustment lever 36 in the direction of the arrow h, the tensioning spring 35 is placed under greater tension and consequently the monitoring needle 32 is acted upon by a greater spring force. FIG. 5 shows the device once again with a closed clamping pad 5, and a lowered monitoring needle 32. The differing adjustment of both the adjustment levers may be read off on the scale on the cover plate 26. Naturally, just one of the two adjustments may be altered, in accordance with any individual case.

Inasmuch as the invention is subject to modifications and variations, the foregoing description and accompanying drawings should not be regarded as limiting the invention, which is defined by the following claims and various combinations thereof.

I claim:

1. A device for monitoring and controlling a thread on a warping creel, said device comprising:

a thread clamp having a fixed portion and a movable clamping pad for firmly clamping a thread (3) against the fixed portion in a closed position of the pad, a pressure peg connected to the clamping pad and extending away from the fixed portion, a spring (4) mounted on the pressure peg and providing a force against the clamping pad for biasing the clamping pad toward said closed position, and means for adjusting the spring force, said adjusting means comprising a counter bearing (10) for supporting an end of the spring opposite the clamping pad, the counter bearing being movable with respect to the pressure peg, a linearly displaceable slider (17) having a guide element (19) with a sloping surface supporting said counter bearing, and means (21) for sliding the slider so as to displace the guide element and counter bearing and thus vary force applied by said spring to said pad; and a thread monitor (2) having a spring loaded monitor needle for creating thread tension and means for activating the clamping device to clamp the thread when the thread breaks.

2. A device according to claim 1, wherein the means for sliding the slider comprises an adjustment lever (21) for displacing the slider (17), the lever being pivotally mounted and having a free end connected to the slider by a prismatic joint.

3. A device according to claim 2, further comprising a cover plate (26) which covers the clamping device and the adjustment lever.

4. A device according to claim 3, wherein the cover plate has an opening (28) provided with marking there along for indicating the position of the adjustment lever.

5. A device according to claim 1, wherein the slider is movable in a direction approximately perpendicular to the pressure peg (6), and has a slot (18) through which the pressure peg passes.

* * * * *